US006902804B2

(12) United States Patent
Kwon et al.

(10) Patent No.: US 6,902,804 B2
(45) Date of Patent: Jun. 7, 2005

(54) LYOCELL MULTIFILAMENT

(75) Inventors: Ik-Hyeon Kwon, Seoul (KR); Soo-Myung Choi, Kyonggi-do (KR); Young-Soo Wang, Busan (KR); Sung-Ryong Kim, Daejun (KR); Jae-Shik Choi, Seoul (KR); Tae-Jung Lee, Kyonggi-do (KR); Seok-Jong Han, Kyonggi-do (KR)

(73) Assignee: Hyosung Corporation, Kyonggi-do (KR)

( * ) Notice: Subject to any disclaimer, the term of this patent is extended or adjusted under 35 U.S.C. 154(b) by 0 days.

(21) Appl. No.: 10/874,222

(22) Filed: Jun. 24, 2004

(65) Prior Publication Data

US 2005/0019564 A1 Jan. 27, 2005

(30) Foreign Application Priority Data

Jul. 25, 2003 (KR) ..... 10-2003-0051416

(51) Int. Cl.[7] ..... D01F 6/00
(52) U.S. Cl. ..... 428/364; 428/393; 152/451
(58) Field of Search ..... 428/364, 393, 428/34.1; 152/451

(56) References Cited

U.S. PATENT DOCUMENTS

| | | | | |
|---|---|---|---|---|
| 4,142,913 | A | 3/1979 | McCorsley et al. | 106/200.3 |
| 4,144,080 | A | 3/1979 | McCorsley et al. | 106/200.3 |
| 5,094,690 | A | 3/1992 | Zikeli et al. | 106/200.2 |
| 5,421,525 | A | 6/1995 | Gray et al. | 241/19 |
| 5,456,748 | A | 10/1995 | Quigley et al. | 106/200.1 |
| 5,534,113 | A | 7/1996 | Quigley et al. | 159/49 |
| 5,584,919 | A | 12/1996 | Lee et al. | 264/186 |
| 5,603,883 | A | 2/1997 | Zikeli | 264/187 |
| 5,888,288 | A | 3/1999 | Quigley et al. | 106/200.3 |
| 5,921,675 | A | 7/1999 | Zikeli et al. | 366/186 |
| 5,942,327 | A | 8/1999 | Budgell et al. | 428/364 |
| 5,948,905 | A | 9/1999 | Connor et al. | 536/124 |

FOREIGN PATENT DOCUMENTS

| | | |
|---|---|---|
| GB | 2 374 326 A | 10/2002 |
| GB | 2 389 111 A | 12/2003 |
| WO | 1994/06530 | 3/1994 |
| WO | 1997/47790 | 12/1997 |

*Primary Examiner*—N. Edwards
(74) *Attorney, Agent, or Firm*—Nixon & Vanderhye P.C.

(57) ABSTRACT

The present invention relates to a high tenacity, high modulus and low shrinkage lyocell multifilament yarn suitable for use in tire cords and MRG (mechanical rubber goods). The lyocell multifilament yarn is a cellulose-based fiber for industrial applications, which is produced by dissolving pulp having a degree of polymerization ($DP_W$) of 700–2,000 and preferably 800–1,400, and a α-cellulose content of more than 90% and preferably more than 92%, in N-methylmorpholine N-oxide (NMMO) hydrate, at a pulp concentration of 5–15% by weight and preferably 8–13% by weight.

The lyocell monofilament according to the present invention is characterized by the following stress-strain profile: (1) the lyocell monofilament analyzed after drying is elongated by less than 3.0% and has an initial modulus of 150–400 g/d, when it was subjected to an initial stress of 3.0 g/d; (2) it is elongated by 3.0–7.0% when it was subjected to a stress greater than the initial stress but smaller than 6.0 g/d; and (3) it is elongated from a tensile tenacity of at least 6.0 g/d until the yarn is broken.

9 Claims, 5 Drawing Sheets

LYOCELL MULTIFILAMENT

BACKGROUND OF THE INVENTION

1. Field of the Invention

The present invention relates to a high tenacity, high modulus and low shrinkage lyocell multifilament yarn suitable for industrial fibers, and preferably fibers for tire cords or MRG. More particularly, the invention relates to the production of a lyocell filament suitable for tire cords or MRG (mechanical rubber goods), in which the lyocell filament is produced by dissolving cellulose having a degree of polymerization ($DP_W$) of 700–2,000, and a α-cellulose content of more than 90% in N-methylmorpholine N-oxide (hereinafter, referred to as NMMO)/water and spinning the cellulose solution by a dry-wet spinning process.

2. Background of the Related Art

As a frame forming the inner part of a tire, a tire cord is used at large amounts, and regarded as an important factor in the maintenance of a tire shape or ride comfort. Various tire cord materials, such as polyester, nylon, aramid, rayon and steel, are currently used, but they do not satisfy perfectly various functions required in the tire cord. Basic performances required in such tire cord materials are as follows: (1) high tenacity and high initial modulus; (2) thermal resistance, and non-deterioration in dry and wet heat; (3) fatigue resistance; (4) dimensional stability; (5) excellent adhesion to rubber, and the like. Thus, the tire cord materials are used in applications according to their intrinsic physical properties.

Among them, the greatest advantages of the rayon tire cord are its excellent thermal resistance and dimensional stability, and its elastic coefficient is maintained even at high temperature. Owing to such low shrinkage and excellent dimensional stability, it has been mainly used in high-speed radial tires for automobiles and the like. However, the rayon tire cord produced according to prior art has disadvantages in that tenacity and modulus are low, and a reduction in tenacity is shown due to its chemical and physical structures easy to absorb moisture.

Many kinds of fiber materials are used as a reinforcement material for hoses with gas or liquid conveyance and transport functions, conveyer belts with solid conveyance function, and transmission belts with power transfer function. Performance requirements of such materials include excellent tenacity, elasticity, creep, adhesion, thermal resistance, bending resistance and impact resistance.

Of them, when a rayon fiber is used as the reinforcement material, it have advantages in that it has little or no deformation even at high temperature and shows superior adhesion and bending properties. However, due to low elasticity and high elongation, it is disadvantageous in that it can be deformed when it undergoes a long-term or high load.

The prior industrial rayon which is used for tire cords or MRG is a fiber which is produced by the same wet spinning process as in viscose rayon except that several spinning conditions are changed to increase the tenacity of the fiber. Namely, it is produced by a method of increasing degree of orientation by increasing draw ratio in a drawing step after coagulation, and a method of increasing the amount of adding of $ZnSO_4$ in a coagulation step to increase crystallinity while increasing a fiber skin layer (i.e., skin portion) to increase tenacity. However, to produce this fiber, cellulose is reacted with carbon disulfide to produce celluose-xanthate and dissolved in dilute sodium hydroxide solution to make a cellulose spinning solution. The spinning solution is spun in an aqueous sulfuric acid solution to produce a fiber. Thus, this production method has disadvantages in that a process is lengthened, large amounts of chemicals are used, and highly inflammable poisonous chemicals, such as carbon disulfide, must be handled. Also, it has an environmental problem in that hydrogen sulfide gas causing a nervous system disorder is generated during the production process.

In U.S. Pat. No. 5,942,327 which discloses the lyocell fibers produced according to prior art, cellulose was swollen in about 78 wt % of NMMO and then subjected to a distillation process to produce a cellulose solution. This patent showed that the tenacity and elongation of the cellulose filaments manufactured from this cellulose solution varied depending on air gap temperature, nozzle orifice diameter, and the temperature of a coagulation bath containing additives such as $NH_4Cl$ or $CaCl_2$. In this case, the nozzle orifice diameter was changed to 130 μm and 200 μm. However, the manufactured cellulose filaments have a high elongation of about 9.0–13.0% due to low draw ratio, but they are disadvantageous in that they have a tenacity lower than 6.0 g/d, which makes it difficult to provide a lyocell fiber having superior physical properties to the prior rayon fiber for tire cords and MRG.

SUMMARY OF THE INVENTION

Accordingly, the present invention has been made to solve the problems of low tenacity and low initial modulus with the prior viscose rayon tire cords, and an object of the present invention is to provide a lyocell monofilament and a lyocell multifilament consisting of an aggregate of lyocell monofilaments with a stress-strain curve suitable for industrial applications, particularly tire cords or MRG, in which the lyocell monofilament is produced by dissolving cellulose directly in NMMO hydrate as a solvent, and suitably adjusting the conditions of the spinning, water-washing, oil-treating and drying of the cellulose solution.

In the present invention, the stress-strain profile of a viscose rayon monofilament, which is commercially used, was first analyzed. Also, in order to improve the low tenacity and low initial modulus of the viscose rayon, a method of dissolving cellulose in NMMO and dry-wet spinning process using air gap, which are distinguished from the prior process of producing viscose rayon, were used to produce a lyocell multifilament. The dry-wet spinning process has an advantage in that it allows independent setting of solution spinning temperature and desolvation bath temperature, such that it can induce a contact fiber structure by the adjustment of desolvation rate to increase mechanical properties, and it can increase the molecular orientation of a fiber by tensile stress that is applied depending on the winding speed of solution spun from a nozzle. Thus, by forming a fiber structure having high degree of molecular orientation and crystallinity, an attempt was made to improve the low tenacity and low initial modulus of a rayon fiber produced by the prior viscose rayon process.

To accomplish the above object, according to an aspect of the present invention, there is provided a lyocell monofilament, which has a stress-strain curve wherein (A) the lyocell monofilament analyzed after drying is elongated by less than 3.0% and has an initial modulus of 150–400 g/d, when it was subjected to an initial stress of 3.0 g/d, (B) it is elongated by 3.0–7.0% when it was subjected to a stress greater than the initial stress but smaller than 6.0 g/d, and (C) it is elongated from a tensile tenacity of at least 6.0 g/d until the yarn is broken.

According to another aspect of the present invention, there is also provided a lyocell multifilament which consists of an aggregate of 40–4,000 of the said lyocell monofilaments.

Preferably, the heat shrinkage of the said lyocell multifilament is 0.1–3.0%.

Preferably, the tensile tenacity of the said lyocell multifilament is 4.5–10.0 g/d.

Preferably, the number of interlacing per meter in the said lyocell multifilament is 2–40.

According to another aspect of the present invention, there is also provided a method for producing lyocell multifilaments which comprises the step of: (A) dissolving cellulose in a solvent mixture of N-methylmorpholine N-oxide (NMMO) and water, to produce a dope; (B) extruding the dope through a spinning nozzle including orifices with a diameter of 100–300 $\mu$m, a length of 200–2,400 $\mu$m, a length-to-diameter ratio (L/D) of 2–8 and an orifice density of 4–100 orifices/cm$^2$, and passing the fibrous dope through an air gap to a coagulation bath, and then coagulating the fibrous dope to obtain a multifilament; (C) introducing the multifilament into a water-washing bath to water-wash the multifilament; (D) continuously passing the water-washed multifilament through oil-treating device and an interlacing nozzle located at the back of the oil-treating device to promote oil dispersion on the multifilament and to provide the multifilament with interlacing; and (E) drying and winding the multifilament having the interlacing.

Preferably, the said cellulose is single or mixed wood pulp having a degree of polymerization ($DP_w$) of 700–2,000 and a $\alpha$-cellulose content of more than 90%.

Preferably, the said interlacing nozzle has an air pressure of 0.5–4.0 kg/cm$^2$.

According to another aspect of the present invention, there is also provided a lyocell tire cord produced by a method comprising the steps of: twisting the said lyocell multifilament with a twisting machine to produce a greige cord; and dipping the greige cord in a dipping solution.

According to another aspect of the present invention, there is also provided a tire comprising the said lyocell tire cord at a carcass or a cap ply.

According to another aspect of the present invention, there is also provided a hose comprising the said lyocell multifilament as a reinforcement material.

According to another aspect of the present invention, there is also provided a belt comprising the said lyocell multifilament as a reinforcement material.

DETAILED DESCRIPTION OF THE PREFERRED EMBODIMENT

Hereinafter, the present invention will be described in detail.

Preferably, to produce the lyocell filament as described in the present invention, pulp with high cellulose purity is used, and to produce a high-quality cellulose-based fiber, pulp with high $\alpha$-cellulose content is used. The use of cellulose molecules with the high degree of polymerization (DP) results in the high orientation and high crystallization of the filament, so that the high tenacity and high initial modulus of the filament can be expected.

Accordingly, cellulose used in the present invention is characterized in that it is pulp having a degree of polymerization (DPW) of 700–2,000 and a $\alpha$-cellulose content of at least 90%.

In the present invention, a homogeneous cellulose solution, that is an element essential to produce the lyocell filament for tire cords and MRG with high tenacity and high modulus is preferably produced by the following method. In an example of the preferred method, a small amount of cellulose powders or polyvinylalcohol is dissolved in concentrated liquid NMMO such that NMMO can be fed into an extruder in a liquid state at relatively low temperature. Due to the effect of lowering the solidification temperature of NMMO, a process temperature range can be widen and also cellulose powders can be smoothly swollen in NMMO solution at low temperature, so that a phenomenon where NMMO is previously dissolved on the outer surface of the cellulose powders to form a coating film making it difficult to penetrate NMMO into the cellulose powders (i.e., a phenomenon where a coating film is formed on the surface of the cellulose powders) can be prevented. Thus, a homogeneous cellulose solution can be produced even at low temperature finally.

Figure 1:
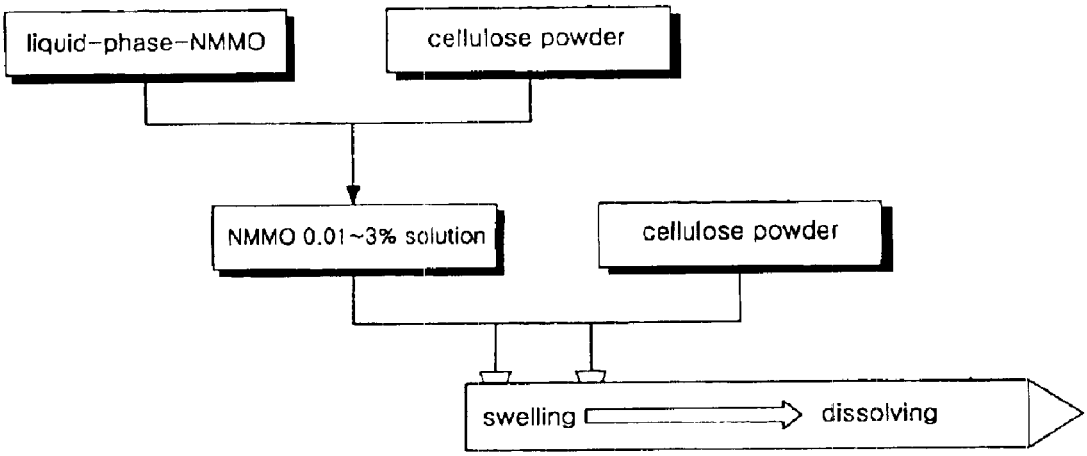
FIG. 1 is a block diagram illustrating an embodiment of the method of preparing cellulose solution that is homogeneous by dissolving a small amount of cellulose powder in NMMO solvent.
Figure 2:
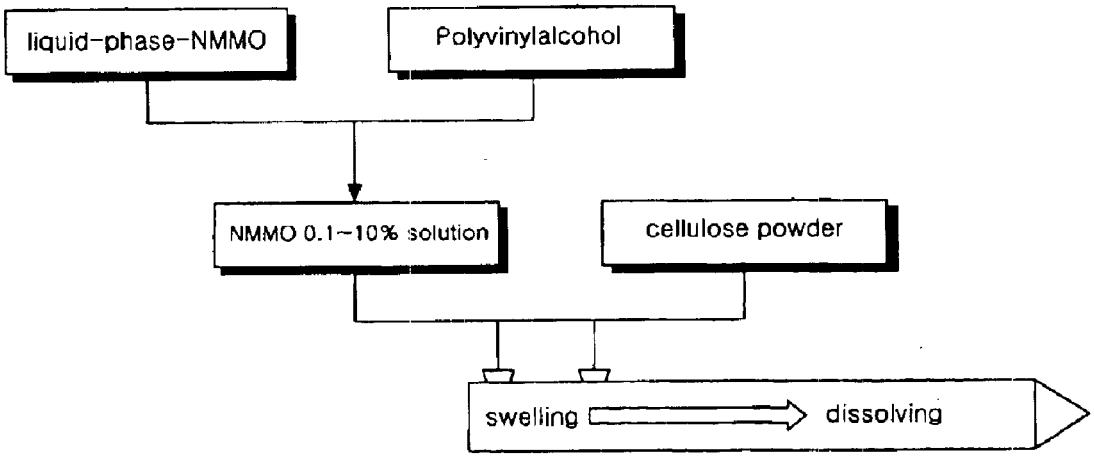
FIG. 2 is a block diagram illustrating an embodiment of the method of preparing cellulose solution that is homogeneous by dissolving a small amount of polyvinylalcohol in NMMO solvent.
Figure 3:
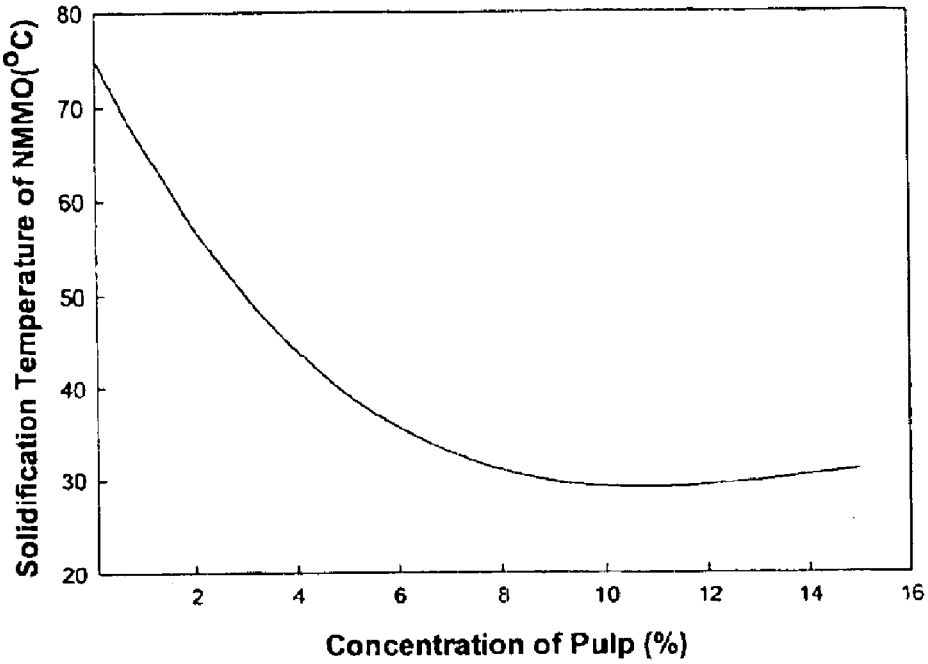
FIG. 3 is a graph illustrating the history of shift of the solidification temperature of the NMMO solution versus the concentration of the cellulose pulp.
Figure 4:
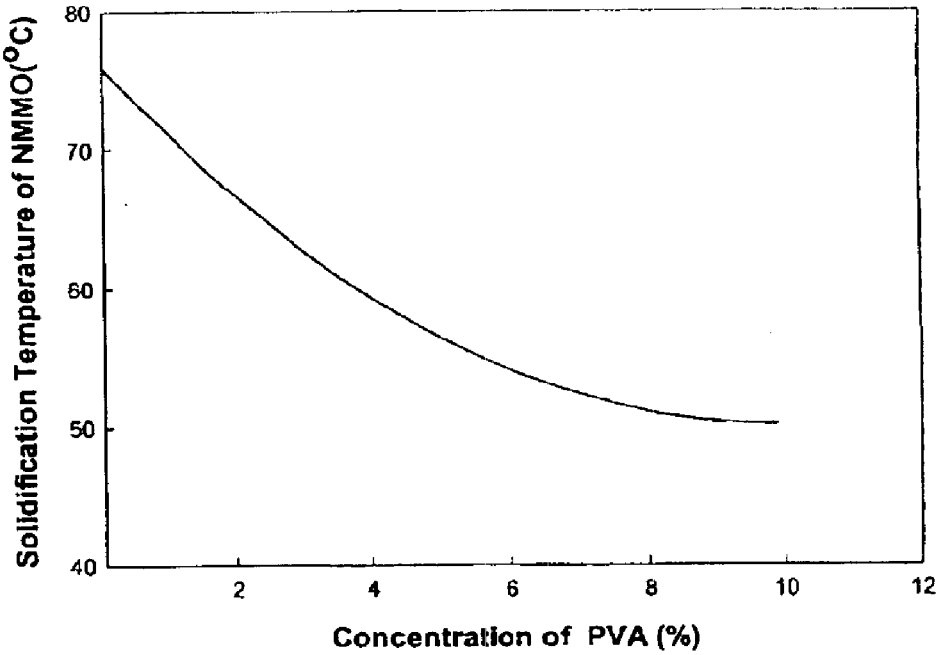
FIG. 4 is a graph illustrating the history of shift of the solidification temperature of the NMMO solution versus the concentration of the polyvinylalcohol.

FIG. 1 and FIG. 2 are examples of this invention, and they are block diagrams illustrating an embodiment of the method of preparing cellulose solution which is homogeneous at relatively low temperature by dissolving a small amount of cellulose powder or polyvinylalcohol in NMMO solvent. FIG. 3 is a graph illustrating the history of shift of the solidification temperature of the NMMO solution versus the concentration of the cellulose pulp. In this figure, the solidification temperature of the NMMO is greatly lowered from 75° C. to 30° C. by dissolving a small amount of cellulose (about 0.1 to 6% by weight). FIG. 4 is a graph illustrating the history of shift of the solidification temperature of the NMMO solution versus the concentration of the polyvinylalcohol. In this figure, the solidification temperature of the NMMO is greatly lowered from 75° C. to 50° C. by dissolving a small amount of polyvinylalcohol(about 0.1 to 6% by weight).

Figure 5:
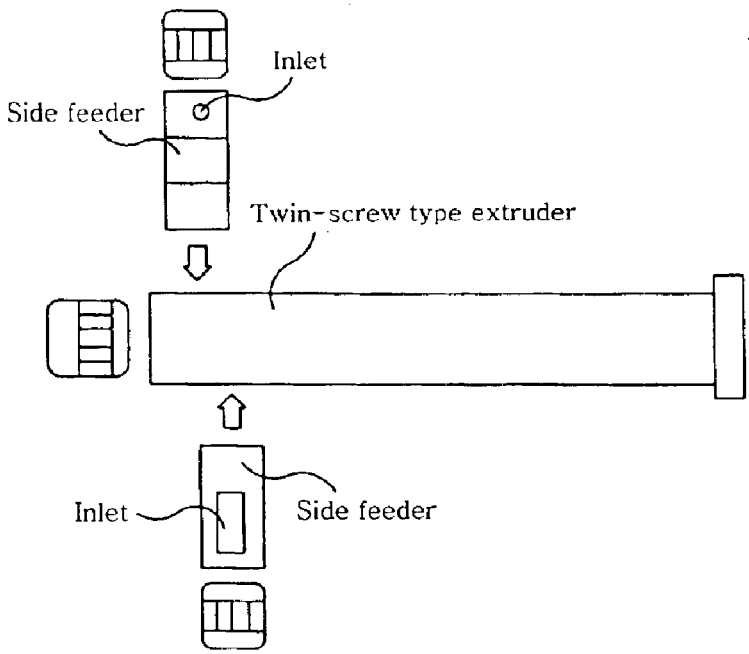
FIG. 5 is a scheme of the manufacturing apparatus for making cellulose solution according to the present invention.
Figure 6:
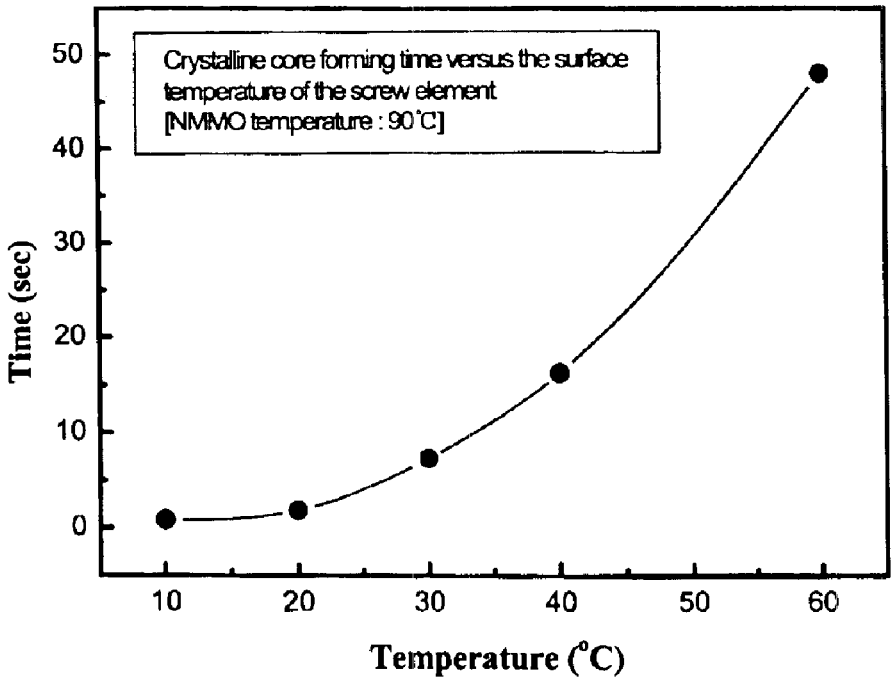
FIG. 6 is a graph illustrating crystalline core forming time versus the surface temperature of the screw element of the manufacturing apparatus for making cellulose solution according to the present invention.

In another preferred method for producing the homogeneous cellulose solution according to the present invention, a highly concentrated liquid NMMO is cooled below its melting point in a separate screw system maintained at low temperature to produce a solid NMMO, and then the NMMO powders maintained at a solid phase are fed into an extruder in which they are uniformly dispersed and mixed with cellulose, compressed and sheared, so that a homogeneous cellulose solution, which was dissolved after sufficient swelling, can be produced. FIG. 5 schematically shows a process of producing cellulose solution, in which NMMO powders maintained at a solid phase are fed into an extruder. FIG. 6 relates to a NMMO hydrate-feeding device of a twin screw extruder type in a system for producing a cellulose solution according to the present invention, and shows the result of measurement of crystalline core forming time versus the surface temperature of a screw element when contacted with liquid NMMO hydrate with a 2-mm thickness. FIG. 6 provides the evaluation of the time required for the production of solid NMMO hydrate from the liquid NMMO hydrate. As shown in FIG. 6, it can be found that, when the temperature of NMMO is 90° C. and the temperature of the screw element surface is below 30° C., the crystalline core is formed within 10 seconds.

Figure 7:
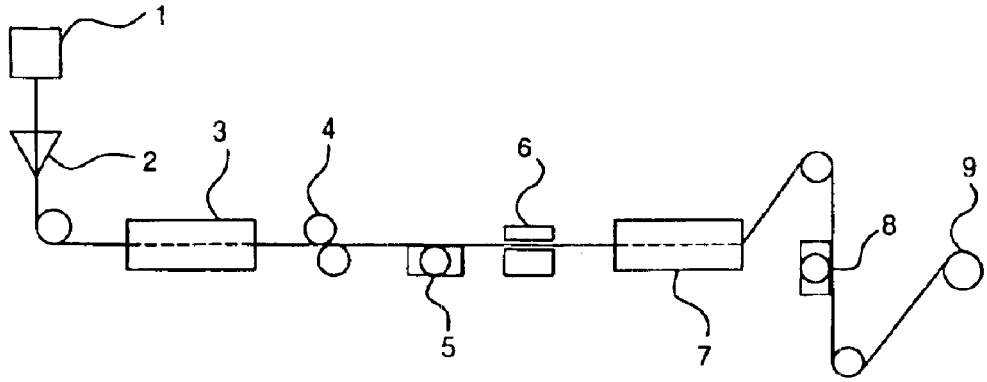
FIG. 7 is a schematic diagram showing a spinning process for producing a high tenacity lyocell filament for tire cords according to the present invention.

After the homogeneous cellulose solution produced by the above mentioned method is spun through a nozzle with an orifice diameter of 100–300 $\mu$m, an orifice length of 200–2, 400 $\mu$m and an orifice length-to-diameter (L/D) ratio of 2–8, lyocell filaments can be obtained through a process shown in FIG. 7. Producing the lyocell filament through the process as shown in FIG. 7 is a characteristic of the present invention, and will now be described in detail.

First, a solution extruded from a spinning nozzle 1 is passed through an air gap in a vertical direction, and solidified in a coagulation bath 2. In this case, to obtain a compact and homogeneous fiber and to provide a smooth cooling effect, the spinning process is performed adjusting an air gap to the range of about 10–300 mm.

Then, the filament passed through the coagulation bath 2 is passed through a water-washing tank 3. At this time, the coagulation bath 2 and water-washing tank 3 are maintained at a temperature of 5–30° C., in order to prevent a deterioration of the physical properties of the filaments, which is caused by the formation of pores within fiber tissues, which results from rapid solvent removal.

Next, the fiber passed through the water-washing tank 3 is passed through a squeezing roller 4 to remove water, and then passed through a first oil-treating device 5. The filament yarn obtained as described above has high flatness by virtue of the effects of the squeezing roller 4 and the first oil-treating device 5, and contains both oil and water.

To improve flatness and thus enhance coherence and to produce a filament having uniform oil dispersion degree by maximizing an oil-dispersing effect, the filament is passed through an interlacing nozzle 6. At this time, the interlacing nozzle is maintained at an air pressure of 0.5–4.0 kg/cm$^2$, and the number of interlacing per meter of the filament is 2–40. To improve a dispersion effect in an oil-treating step after drying and to enhance coherence, the interlacing nozzle may also be used before winding.

Thereafter, the filament yarn passed through the interlacing nozzle 6 is dried through a drying device 7. The drying temperature and manner in this step will have a great effect on a subsequent process for the filament and the physical properties of the filament. In the present invention, the drying temperature is controlled such that process water content can become about 8–12%.

Then, the filament passed through the drying device 7 is passed through a second oil-treating device 8 and wound up on a winder 9 finally.

The filament, which was passed through the spinning, coagulation, water-washing, oil-treating, drying and winding-up processes as described above, is provided as a filament yarn for industrial materials, such as tire cords, and for clothes.

Hereinafter, this invention is described in detail with referenced to the following examples, but it is to be understood that the examples is solely for the purpose of illustration and do not limit the scope of this invention. In the following examples, the physical properties of cellulose solution and filament were measured using the following measuring method.

(a) Degree of Polymerization ($DP_W$)

The intrinsic viscosity [IV] of the dissolved cellulose is measured as follows. 0.5M cupriethylenediamine hydroxide solution in the range of 0.1 to 0.6 g/dl concentration obtained according to ASTM D539-51T is measured by using an Uberod viscometer at 25±0.01° C. The intrinsic viscosity is calculated from the specific viscosity by using the calculation method of extrapolation and then Mark-Houwink's equation to obtain the degree of polymerization.

$$[IV]=0.98\times10^{-2}DP_W^{0.9}$$

(b) Spinnability

By a method of cutting a filament yarn into one-meter units and taking only 0.1-meter from them, five samples are made and then dried in a load-free state at 107° C. for 2 hours. Whether the dried samples are adhered or not and whether abnormal filaments by cutting of yarn exist or not are examined with the naked eye by an image analyzer. Here, a case of the adhesion between filament yarns caused by inferior spinning, or a case of cutting of yarns, is evaluated as fail (F), and other cases are evaluated as pass (P).

(c) Tenacity(g/d) and Initial Modulus(g/d)

After drying at 107° C. for 2 hours, a sample is applied with a initial load of 200 mg using the monofilament tensile tester Vibrojet 2000 (Lenzing Co.). Then, the tenacity of the sample is measured at a test speed of 20 mm/min to the gauge length of 20 mm. Initial modulus indicates the slope of a graph before yield point.

(d) Shrinkage %

The shrinkage is obtained by the ratio of the length(L0) measured at 20 g static load after being treated at 25° C., 65% RH for 24 hours to the length(L1) measured at 20 g static load after being treated at 150° C. for 30 minutes.

$$S(\%)=(L_0-L_1)/L_0\times100$$

(e) Number of Interlacing

The number of interlacing per unit length in the length direction of a yarn was measured by running a filament yarn through an interlace measurement machine and then placing a sharp pin on the middle of the running yarn. Here, the number of interlacing per meter is indicated.

EXAMPLE 1~7

Pulp with a degree of polymerization ($DP_W$) of 800–1,650 (sold from Buckeye Co.) was pulverized into powders with a size of less than 500 $\mu$m. Then, the powders were forcibly fed into a twin-screw extruder by a side feeder for pulp supply. NMMO hydrate with a water content of 13.0 wt % was maintained at 90° C. and continuously fed into a side feeder for NMMO supply using a metering pump. At this time, a screw within the side feeder for NMMO supply was adjusted to 30° C. to solidify the NMMO which had been fed in a liquid state. After the cellulose powders and the solid NMMO were introduced into the twin-screw extruder adjusted to a temperature of 50–110° C., they were subjected to mixing, shearing and dissolution steps to prepare homogeneous cellulose solution. Then, the cellulose solution was spun at 150 m/min.

In the spinning step, the number of orifices in a spinning nozzle was 1,000, and the orifice diameter was 120–200 $\mu$m. The solution spun from the spinning nozzle with an orifice length-to-diameter (L/D) ratio of 6 and an outer diameter of 100 mmΦ was passed through an air gap with an 80 mm length, and the final filament fineness was 1,500 deniers. Coagulation liquid was adjusted to a temperature of 20° C. and a concentration of 20% NMMO aqueous solution. The temperature and concentration of the coagulation liquid were continuously monitored with a refractometer. The filament released from the coagulation bath was subjected to a water-washing process to remove the remaining NMMO. The water-washed filament was passed through a first oil-treating device and then through an interlacing nozzle having an air pressure of 0.5–3.5 kg/cm$^2$. Next, the filament was dried and wound up. The OPU(Oil-Pick Up) of the wound-up filament yarn was adjusted to 0.5%. The spinning conditions and parameters in this Example are summarized in Table 1 below, and the physical properties of the produced monofilament yarn are given in Table 2 below.

COMPARATIVE EXAMPLE 1

A Super-III yarn, which is currently commercialized and used as a rayon tire cord, was evaluated by the same method as in Examples. The results are also given in Tables 1 and 2.

EXAMPLES 8–14

A cellulose solution was produced as described below and then spun through a nozzle in the same manner in Example 1. A cellulose sheet that the weight mean degree of polymerization is 1,200 were fed into a pulverizer to produce cellulose powder having a particle size of less than 500 micrometers, and then, the cellulose powder were dissolved in NMMO to produce a NMMO solution containing cellulose of 0.1 to 3.0% by weight. NMMO solution in which the cellulose had been dissolved at 0.1–3.0% by weight was fed into the feed portion of an extruder having an internal temperature of 65° C. using a metering pump. Thus, this Example is characterized by the method where the solution in which a small amount of cellulose had been dissolved in molten NMMO was introduced into the extruder. The concentration of cellulose dissolved in NMMO is termed "first cellulose concentration".

At this time, the cellulose powders were adjusted to a given concentration in view of total cellulose concentration and forcibly fed into the extruder by a screw-type feeder. Here, the total concentration of cellulose, which is fed into the extruder, was adjusted to 8–15% by weight. The concentration of cellulose fed into the extruder is termed "second cellulose concentration".

The first and second celluloses, which had been fed into the extruder, were sufficiently swollen by kneading with the NMMO solution for a retention time of 0.1–3 minutes in the swelling section of the extruder. Then, they were dissolved in the dissolution section of the extruder while maintaining the temperature of each block at 70–110° C. and applying sufficient shear by rotation of the extruder screw. Then, the cellulose solution was passed through a brake plate, passed through a given filtering device, and spun through a nozzle at a speed of 150 m/min. The spinning conditions and

TABLE 1

| Sample Condition | Ex. 1 | Ex. 2 | Ex. 3 | Ex. 4 | Ex. 5 | Ex. 6 | Ex. 7 | Comparative Ex. 1 |
|---|---|---|---|---|---|---|---|---|
| Degree of polymerization of Cellulose | 1200 | 1200 | 1200 | 1200 | 1650 | 1050 | 800 | — |
| Cellulose Concentration (%) | 9.0 | 11.5 | 13.0 | 11.0 | 11.2 | 13.0 | 15.0 | — |
| Spinning Speed(m/min) | 180 | 150 | 150 | 200 | 120 | 150 | 160 | — |
| Air Pressure(kg/cm$^2$) | First-0.5 | 1.5 | 0.5 | 1.5 | 1.5 | 0.5 | 3.5 | — |
| Number of Interlacing per meter | 9 | 18 | 11 | 31 | 19 | 20 | 25 | — |
| Fineness | 1510 | 1520 | 1505 | 1530 | 1510 | 1510 | 1500 | 1500 |

TABLE 2

| Sample Condition | Ex. 1 | Ex. 2 | Ex. 3 | Ex. 4 | Ex. 5 | Ex. 6 | Ex. 7 | Comparative Ex. 1 |
|---|---|---|---|---|---|---|---|---|
| Spinnability | P | P | P | P | P | P | P | — |
| Tenacity(g/d) | 6.5 | 8.1 | 8.4 | 7.3 | 8.2 | 7.6 | 6.9 | 6.3 |
| Elongation at 3.0 g/d(%) | 1.3 | 1.1 | 1.0 | 1.3 | 1.1 | 1.7 | 1.26 | 3.2 |
| Elongation at 6.0 g/d(%) | 4.5 | 3.9 | 3.8 | 4.8 | 4.0 | 5.0 | 4.4 | 10.8 |
| Elongation at Break(%) | 6.8 | 6.5 | 7.2 | 7.0 | 7.0 | 7.4 | 7.1 | 12.0 |
| Initial Modulus(g/d) | 280 | 290 | 305 | 290 | 318 | 280 | 270 | 160 |
| Shrinkage(%) | 0.9 | 0.4 | 0.3 | 0.6 | 0.3 | 0.5 | 0.7 | 1.7 |

parameters in this Example are summarized in Table 3 below, and the physical properties of the produced monofilament yarn are given in Table 4 below.

TABLE 3

| Sample Condition | Ex. 8 | Ex. 9 | Ex. 10 | Ex. 11 | Ex. 12 | Ex. 13 | Ex. 14 |
|---|---|---|---|---|---|---|---|
| Degree of polymerization of Cellulose | 1200 | 1200 | 1200 | 1200 | 1200 | 1200 | 1200 |
| First Cellulose Concentration (%) | 0.1 | 0.5 | 1.0 | 2.0 | 3.0 | 1.0 | 1.0 |
| Second Cellulose Concentration(%) | 10.9 | 10.6 | 10.2 | 9.0 | 8.0 | 7.3 | 13.9 |
| Fineness | 1510 | 1520 | 1505 | 1530 | 1510 | 1510 | 1500 |

TABLE 4

| Sample Condition | Ex. 8 | Ex. 9 | Ex. 10 | Ex. 11 | Ex. 12 | Ex. 13 | Ex. 14 |
|---|---|---|---|---|---|---|---|
| Spinnability | P | P | P | P | P | P | F |
| Tenacity(g/d) | 7.9 | 8.0 | 8.5 | 8.3 | 7.7 | 6.8 | — |
| Elongation at 3.0 g/d(%) | 1.3 | 1.2 | 1.2 | 1.1 | 1.0 | 1.7 | — |
| Elongation at 6.0 g/d(%) | 4.5 | 4.0 | 3.8 | 4.4 | 3.9 | 5.0 | — |
| Elongation at Break(%) | 6.8 | 6.6 | 6.5 | 7.0 | 6.5 | 7.7 | — |
| Initial Modulus(g/d) | 280 | 285 | 325 | 295 | 298 | 265 | — |
| Shrinkage(%) | 0.6 | 0.4 | 0.3 | 0.5 | 0.5 | 1.1 | — |

EXAMPLES 15–21

A cellulose solution was produced as described below and then spun through a nozzle in the same manner in Example 1. Polyvinylalchol having a weight mean degree of polymerization of 1,700 and a saponification value of 99.5% were dissolved in NMMO to produce a NMMO solution containing polyvinylalcohol of 1% by weight. Firstly, the NMMO solution containing polyvinylalcohol of 1% by weight was fed into a twin-screw type extruder having its inner temperature maintained at 78° C. through a metering pump at a speed of 6,900 g/hour. The cellulose sheet having a weight mean degree of polymerization of 1,200 was pulverized into cellulose powder having a particle size of less than 500 micrometer using a pulverizer, and then, the cellulose powder was fed into the twin-screw type extruder through a screw-type feeder at the speed of 853 g/hour. Meanwhile, the liquid-state NMMO solution containing polyvinylalcohol of 1% by weight was fed into the extruder with it maintained at 74° C. And then, cellulose powder was fully swollen during the retention time of 0.1 to 3 minutes in the cellulose swelling zone of the extruder. Then the temperature of each block of the dissolving zone of the extruder was maintained at the range of 90 to 105° C. and operated the screw of the extruder at 250 rpm so as to extrude the fully melted solution through the nozzle of the extruder. The spinning conditions and parameters in this Example are summarized in Table 5 below, and the physical properties of the produced monofilament yarn are given in Table 6 below.

TABLE 5

| Sample Condition | Ex. 15 | Ex. 16 | Ex. 17 | Ex. 18 | Ex. 19 | Ex. 20 | Ex. 21 |
|---|---|---|---|---|---|---|---|
| Degree of polymerization of Cellulose | 1200 | 1200 | 1200 | 1200 | 1200 | 1200 | 1200 |
| Cellulose + PVA Concentration (%) | 12.0 | 13.0 | 14.0 | 13.0 | 13.0 | 13.0 | 10.0 |
| Orifice Diameter($\mu$m) | 120 | 150 | 200 | 150 | 150 | 150 | 150 |
| Spinning Speed(m/min) | 150 | 150 | 150 | 90 | 110 | 130 | 150 |
| Length of Air gap(mm) | 80 | 90 | 40 | 100 | 50 | 60 | 70 |
| Quenching Air Velocity(mps) | 6.7 | 5.5 | 7.0 | 6.0 | 5.8 | 6.5 | 6.0 |
| Quenching Air Temperature(° C.) | 20 | 17 | 23 | 15 | 20 | 18 | 18 |
| Quenching Air Humidity(% RH) | 60.0 | 60.0 | 55.0 | 64.0 | 65.0 | 58.0 | 55.0 |
| Fineness | 1510 | 1520 | 1505 | 1530 | 1510 | 1510 | 1500 |

TABLE 6

| Sample Condition | Ex. 15 | Ex. 16 | Ex. 17 | Ex. 18 | Ex. 19 | Ex. 20 | Ex. 21 |
|---|---|---|---|---|---|---|---|
| Spinnability | P | P | P | P | P | P | P |
| Tenacity(g/d) | 8.2 | 8.4 | 7.3 | 7.5 | 8.0 | 7.9 | 7.3 |
| Elongation at 3.0 g/d(%) | 1.05 | 1.00 | 1.26 | 1.30 | 1.28 | 1.57 | 1.32 |
| Elongation at 6.0 g/d(%) | 4.8 | 3.5 | 4.8 | 4.9 | 3.9 | 4.3 | 5.1 |
| Elongation at Break(%) | 6.7 | 6.7 | 7.3 | 7.3 | 7.2 | 7.5 | 7.2 |
| Initial Modulus(g/d) | 290 | 280 | 295 | 266 | 265 | 258 | 240 |
| Toughness(g/d) | 0.292 | 0.298 | 0.290 | 0.304 | 0.309 | 0.310 | 0.293 |

As shown in Examples 1–21 of Tables 2, 4 and 6, the lyocell filament produced according to the present invention has an initial modulus of 265–325 g/d, and a high tenacity of at least 7.0 g/d. Thus, the present invention improves the problems of low tenacity and low initial modulus with the prior viscose rayon, and hence, provides the lyocell filament for tire cords or MRG having excellent dimentional stability and thermal resistance.

Figure 8:
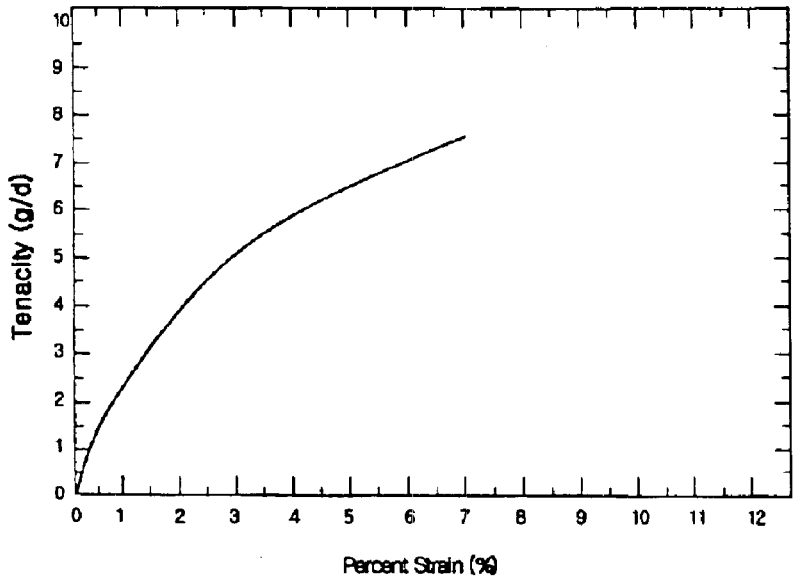
FIG. 8 is a graphic diagram showing an example of the strain-stress (S—S) curve of a lyocell monofilament produced according to the present invention.
Figure 9:
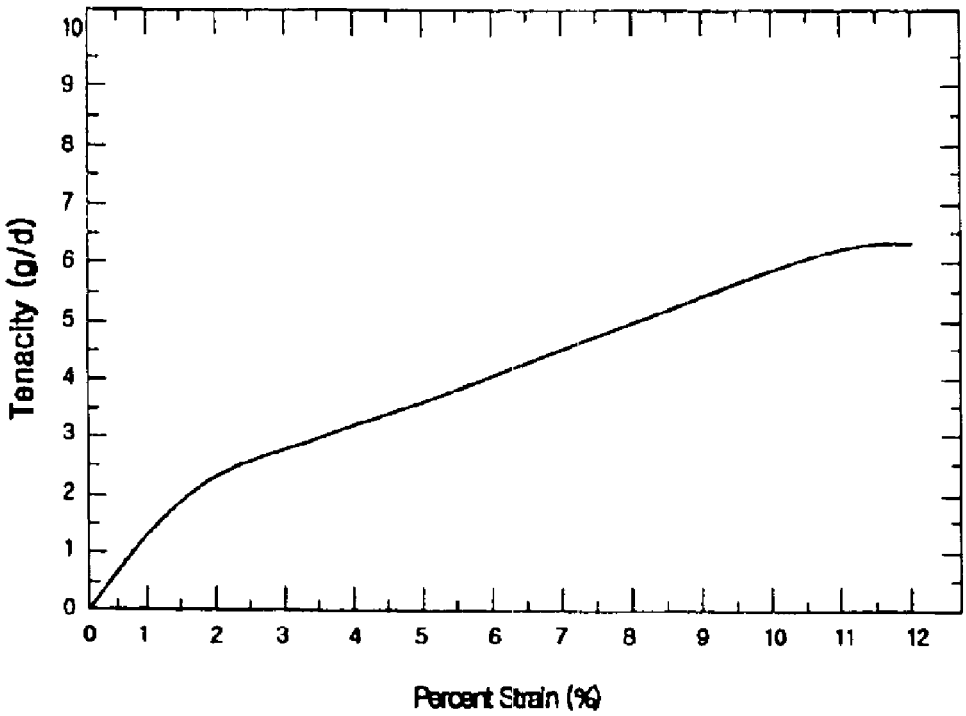
FIG. 9 is a graphic diagram showing the stress-strain (S—S) curve of the viscose rayon (Super-III) monofilament used as a comparative example in the present invention.

FIG. 8 is a graphic diagram showing an Example of the strain-stress (S—S) curve of a lyocell monofilament produced according to the present invention. FIG. 9 is a graphic diagram showing the stress-strain (S—S) curve of the viscose rayon (Super-III) monofilament used as a comparative Example in the present invention.

As described above, the lyocell monofilament produced according to the present invention has a stress-strain curve wherein (1) the lyocell monofilament analyzed after drying is elongated by less than 3% and has an initial modulus of 150–400 g/d, when it was subjected to an initial stress of 3.0 g/d; (2) it is elongated by 3.0–7.0% when it was subjected to a stress greater than the initial stress but smaller than 6.0 g/d; and (3) it is elongated from a tensile tenacity of at least 6.0 g/d until the yarn is broken. Thus, the present invention has the effect of improving the problems of low tenacity and low initial modulus with the prior viscose rayon, to provide a lyocell tire cord or lyocell filaments having excellent dimensional stability and thermal stability.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A lyocell monofilament, which has a stress-strain curve wherein:

(A) the lyocell monofilament analyzed after drying is elongated by less than 3.0% and has an initial modulus of 150–400 g/d, when it was subjected to an initial stress of 3.0 g/d;

(B) it is elongated by 3.0–7.0% when it was subjected to a stress greater than the initial stress but smaller than 6.0 g/d; and (C) it is elongated from a tensile tenacity of at least 6.0 g/d until the yarn is broken.

2. A lyocell multifilament, which consists of an aggregate of 40–4,000 lyocell monofilaments of claim 1.

3. The lyocell multifilament of claim 2, wherein the heat shrinkage of the lyocell multifilament is 0.1–3.0%.

4. The lyocell multifilament of claim 2, wherein the tensile tenacity of the lyocell multifilament is 4.5–10.0 g/d.

5. The lyocell multifilament of claim 2, wherein the number of interlacing per meter in the lyocell multifilament is 2–40.

6. A lyocell tire cord produced by a method comprising the steps of: twisting the lyocell multifilament of claim 2 with a twisting machine to produce a greige cord; and dipping the greige cord in a dipping solution.

7. A tire comprising the lyocell tire cord of claim 6 at a carcass or a cap ply.

8. A hose comprising the lyocell multifilament of claim 2 as a reinforcement material.

9. A belt comprising the lyocell multifilament of claim 2 as a reinforcement material.

* * * * *